US010914474B2

(12) United States Patent
Ming et al.

(10) Patent No.: US 10,914,474 B2
(45) Date of Patent: Feb. 9, 2021

(54) COOKING FUME PURIFICATION MODULE AND COOKING FUME EXHAUST DEVICE

(71) Applicant: MIDEA GROUP CO., LTD., Foshan (CN)

(72) Inventors: Lele Ming, Foshan (CN); Hui Zhang, Foshan (CN); Jizhe Zhang, Foshan (CN); Xiaokang Peng, Foshan (CN); Chubin Ou, Foshan (CN); Yuan Lan, Foshan (CN)

( * ) Notice: Subject to any disclaimer, the term of this patent is extended or adjusted under 35 U.S.C. 154(b) by 293 days.

(21) Appl. No.: 16/228,729

(22) Filed: Dec. 20, 2018

(65) Prior Publication Data

US 2019/0113240 A1 Apr. 18, 2019

Related U.S. Application Data

(63) Continuation of application No. PCT/CN2017/083653, filed on May 9, 2017.

(30) Foreign Application Priority Data

Jan. 20, 2017 (CN) ..... 2017 1 0042839

(51) Int. Cl.
*F24C 15/20* (2006.01)
*B03C 3/47* (2006.01)
(Continued)

(52) U.S. Cl.
CPC ..... *F24C 15/2035* (2013.01); *B03C 3/017* (2013.01); *B03C 3/12* (2013.01);
(Continued)

(58) Field of Classification Search
CPC ..... B03C 3/12; B03C 3/368; B03C 3/017; B03C 3/366; B03C 3/363; B03C 3/47;
(Continued)

(56) References Cited

U.S. PATENT DOCUMENTS 2,841,240 A 7/1958 Wintermute
9,636,617 B2 * 5/2017 Wennerstrom ..... F04D 29/526
(Continued)

FOREIGN PATENT DOCUMENTS

CN 2456845 Y 10/2001
CN 203964097 U 11/2014
(Continued)

OTHER PUBLICATIONS

The first Office Action dated Jul. 9, 2018 in the corresponding CN application No. 201710042839.5.
(Continued)

*Primary Examiner* — Alfred Basichas
(74) *Attorney, Agent, or Firm* — Kilpatrick Townsend & Stockton, LLP

(57) ABSTRACT

A cooking fume purification module and a cooking fume exhaust device are provided. The fume purification module includes a housing, a plurality of dust collection plates and an emitter plate. The housing includes a cylindrical body and a plurality of protruding portions. The body defines an air channel. The plurality of protruding portions extends outwards from the body, and each protruding portion defines an introduction channel in communication with the air channel. The emitter plate is arranged on the protruding portion and provided with a plurality of emitter pins which are located in the introduction channel and face the air channel. The plurality of dust collection plates are arranged in the air channel and spaced apart along an axial direction of the body, and each dust collection plate corresponding to one emitter plate.

18 Claims, 4 Drawing Sheets

(51) Int. Cl.

| | |
|---|---|
| ***B03C 3/41*** | (2006.01) |
| ***B03C 3/017*** | (2006.01) |
| ***B03C 3/36*** | (2006.01) |
| ***B03C 3/12*** | (2006.01) |
| ***B03C 3/60*** | (2006.01) |
| ***B03C 3/15*** | (2006.01) |

(52) U.S. Cl.
CPC ..... *B03C 3/15* (2013.01); *B03C 3/363* (2013.01); *B03C 3/366* (2013.01); *B03C 3/368* (2013.01); *B03C 3/41* (2013.01); *B03C 3/47* (2013.01); *B03C 3/60* (2013.01); *F24C 15/2028* (2013.01); *F24C 15/2042* (2013.01); *B03C 2201/06* (2013.01); *B03C 2201/08* (2013.01); *B03C 2201/10* (2013.01); *B03C 2201/28* (2013.01)

(58) Field of Classification Search
CPC .... B03C 3/41; B03C 3/15; B03C 3/60; B03C 2201/28; B03C 2201/08; B03C 2201/10; B03C 2201/06; F24C 15/2042; F24C 15/2035; F24C 15/2028
See application file for complete search history.

(56) References Cited

U.S. PATENT DOCUMENTS

| | | | | |
|---|---|---|---|---|
| 9,919,252 | B2 * | 3/2018 | Wennerstrom ..... | B01D 46/0032 |
| 2009/0277325 | A1 | 11/2009 | Gottung et al. | |
| 2015/0231645 | A1 | 8/2015 | Engberg et al. | |

FOREIGN PATENT DOCUMENTS

| | | | | |
|---|---|---|---|---|
| CN | 204602410 | U | | 9/2015 |
| CN | 205550568 | U | | 9/2016 |
| CN | 106765412 | A | * | 5/2017 |
| DE | 469780 | C | | 12/1928 |
| DE | 102010052003 | A1 | | 5/2012 |
| GB | 2033256 | A | | 5/1980 |
| JP | 2010203714 | A | | 9/2010 |

OTHER PUBLICATIONS

The Office Action dated Jul. 25, 2019 in the corresponding EP application17892575.6.

* cited by examiner

COOKING FUME PURIFICATION MODULE AND COOKING FUME EXHAUST DEVICE

CROSS-REFERENCE TO RELATED APPLICATION

This application is a continuation of international application PCT/CN2017/083653, filed on May 9, 2017, which claims priority to and benefits of Chinese Patent Application Serial No. 201710042839.5, filed with China National Intellectual Property Administration on Jan. 20, 2017, the entire content of which is incorporated herein by reference.

FIELD

The present disclosure relates to a field of fume exhaust, and more particularly to a cooking fume purification module and a cooking fume exhaust device.

BACKGROUND

Nowadays, fume produced in a home kitchen needs purification to at least some extent first and then is exhausted to the atmosphere, as people are more aware of environmental protection. Therefore, how to improve the performance of fume purification of a cooking fume exhaust device in the home kitchen and how to improve the cleanliness of emitted fume are technical issues which needs solving.

SUMMARY

Embodiments of the present disclosure seek to solve at least one of the problems existing in the related art. Therefore, the present disclosure provides a cooking fume purification module and a cooking fume exhaust device.

The cooking fume purification module according to an embodiment of the present disclosure includes a housing, an emitter plate and a plurality of protruding portions. The housing includes a cylindrical body defining an air channel; and a plurality of protruding portions extending outwards from the body, and each protruding portion defines an introduction channel in communication with the air channel.

The emitter plate is arranged on the protruding portion and provided with a plurality of emitter pins which are located in the introduction channel. The plurality of dust collection plates are arranged in the air channel and spaced apart along an axial direction of the body, and each dust collection plate corresponds to one emitter plate.

In some embodiments, the body is cylindrical, and the plurality of protruding portions tangentially extend outwards from a circumference of the body.

In some embodiments, the cooking fume purification module includes a hub arranged at a center of the air channel, each dust collection plate is connected to the hub and a joint between the protruding portion and the circumference of body in a tangential direction.

In some embodiments, each dust collection plate extends from the hub to the joint in a manner of log spiral.

In some embodiments, the hub defines a plurality of slots, the plurality of slots are spaced apart in a circumferential direction of the hub, and each dust collection plate is detachably inserted in a slot.

In some embodiments, four protruding portions are provided, and the four protruding portions are evenly spaced apart in a circumferential direction of the body.

In some embodiments, the protruding portion defines an opening in communication with an outside of the protruding portion and the introduction channel, and the emitter plate covers the opening.

In some embodiments, each emitter pin is provided with a plurality of rows of emitting tips.

In some embodiments, the cooking fume purification module includes an electrostatic generator, a connecting end of the electrostatic generator is connected to the dust collection plate, and another connecting end of the electrostatic generator is connected to the emitter plate.

In some embodiments, adjacent two dust collection plates define an air sub-channel, each air sub-channel is in communication with a corresponding introduction channel, and a plurality of air sub-channels form the air channel.

In some embodiments, the slot is detachably connected to the dust collection plate by means of interference fit.

The cooking fume exhaust device according to an embodiment of the present disclosure includes the cooking fume purification module according to any one of above embodiments.

In some embodiments, the cooking fume exhaust device defines a greasy fume passage, and the air channel is in communication with the greasy fume passage.

In some embodiments, the cooking fume exhaust device includes a flow-adjustment module arranged in the greasy fume passage. Compared with the cooking fume purification module, the flow-adjustment module is arranged at an upstream of a greasy fume flow, the flow-adjustment module defines a plurality of flow-adjustment passages extending in an axial direction of the greasy fume passage in an undulate manner, and the flow-adjustment passages are in communication with the air channel.

In some embodiments, the flow-adjustment module includes a framework; and a plurality of flow-adjustment plates stacked up on the framework in a radial direction of the greasy fume passage, each flow-adjustment plate undulates and extends in an axial direction of the greasy fume passage, and adjacent two flow-adjustment plates corporately define the flow-adjustment passage.

In some embodiments, the framework is a ring.

In some embodiments, the cooking fume exhaust device includes a wheel arranged in the greasy fume passage.

In some embodiments, the cooking fume exhaust device defines a fume intake opening, and the fume intake opening is in communication with the greasy fume passage.

In the above cooking fume purification module and the cooking fume exhaust device, a static electric field is generated between the dust collection plate and the emitter plate. Air which is ionized around the emitter pins enter the air channel through the introduction channel, greasy fume particles are charged and move, and then are adhered to the dust collection plate. Therefore, the greasy fume is purified, and the cleanliness of the greasy fume is improve.

BRIEF DESCRIPTION OF THE DRAWINGS

Embodiments of the present disclosure will become apparent and more readily appreciated from the following descriptions made with reference to the drawings, in which.

Figure 1:
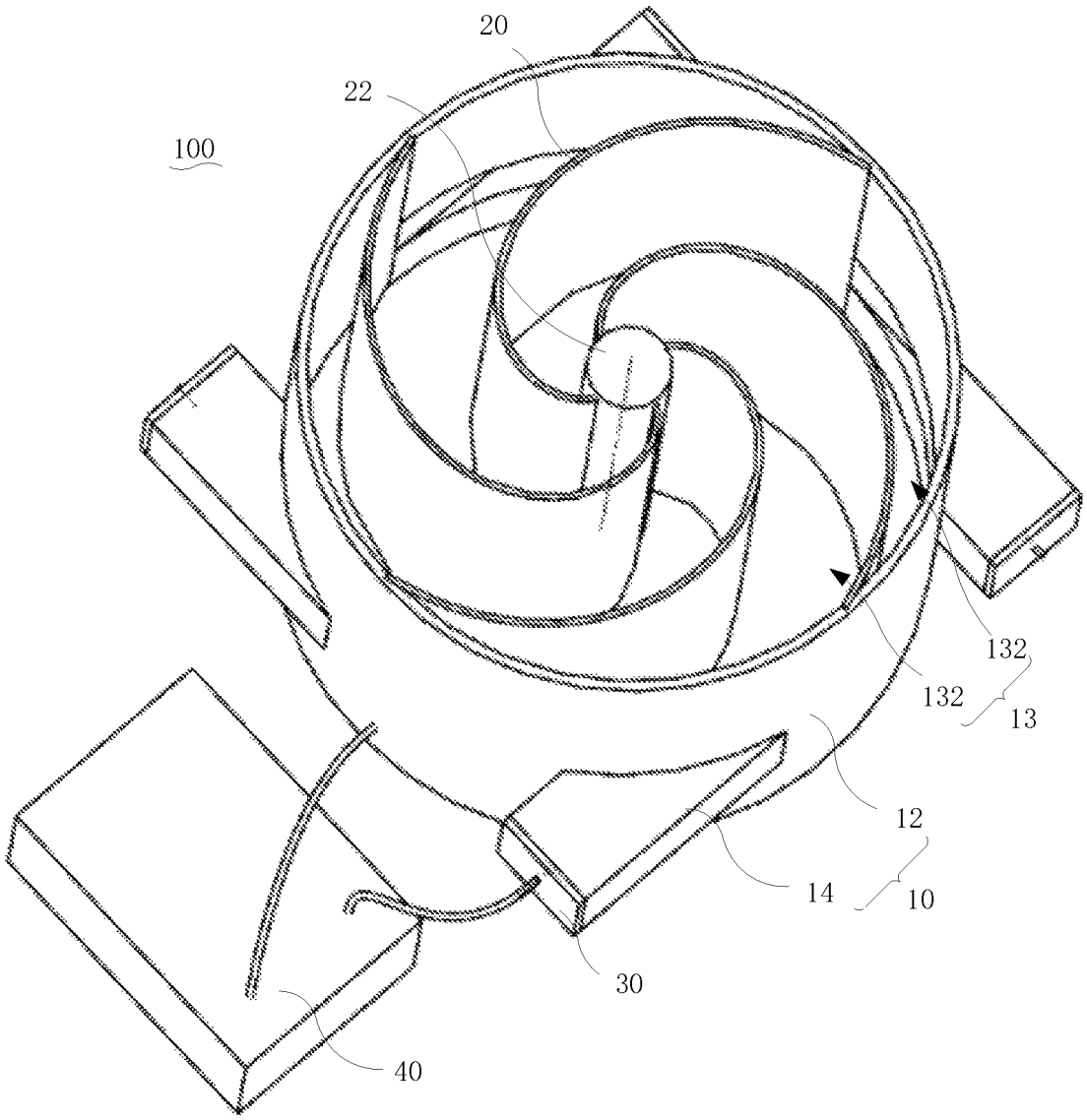
FIG. 1 is a perspective view of a cooking fume purification module of an embodiment of the present disclosure.

MAIN REFERENCE NUMERALS cooking fume purification module 100; housing 10, body 12, air channel 13, air sub-channel 132, protruding portion 14, introduction channel 142, opening 144, joint 15; dust collection plate 20, hub 22, slot 222; emitter plate 30, emitter pin 31; electrostatic generator 40; cooking fume exhaust device 200, fume intake opening 202, filter screen 204, greasy fume passage 206; flow-adjustment module 210, flow-adjustment passage 212, framework 214, flow-adjustment plate 216.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "lateral", "length", "width", "thickness", "upper", "lower", "front", "rear", "left", "right", "vertical", "horizontal", "top", "bottom", "inner", "outer", "clockwise" and "anticlockwise" should be construed to refer to the orientation as then described or as shown in the drawings under discussion. These relative terms are for convenience of description and do not require that the present disclosure be constructed or operated in a particular orientation. Therefore, the above terms should not be construed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means two or more than two, unless specified otherwise.

In the specification, it should be understood that, unless specified or limited otherwise, the terms "mounted," "connected," and "coupled," are used broadly, and may be, for example, fixed connections, detachable connections, or integral connections; may also be mechanical or electrical connections, or mutual communication; may also be direct connections or indirect connections via intervening structures; may also be inner communications of two elements or interaction of two elements.

In the specification, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various different embodiments or examples are provided below to realize different structures of the present disclosure. Components and arrangements of examples are described below for simplifying the present disclosure. Of course, they are examples rather than limit the present disclosure. In addition, reference numerals and/or letters may repeat in different examples of the present disclosure, such repetition is used for simplification and clearness and does not indicate relationship between various embodiments and/or arrangements. Furthermore, the present disclosure provides various examples of specific technics and materials.

Figure 2:
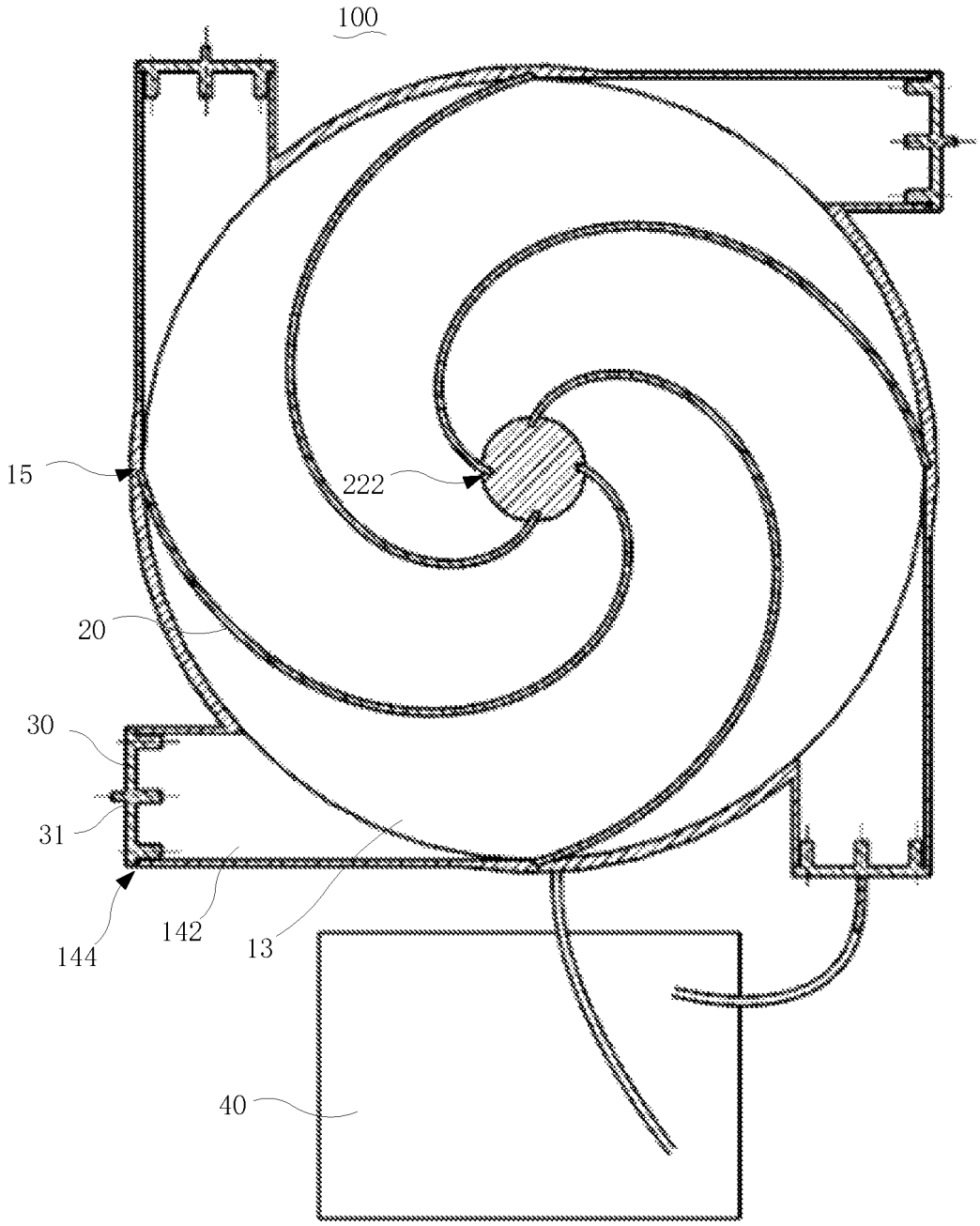
FIG. 2 is a sectional view of a cooking fume purification module of an embodiment of the present disclosure.

Please refer to FIG. 1 and FIG. 2, a cooking fume purification module 100 of an embodiment of the present disclosure includes a housing 10, a plurality of dust collection plates 20 and an emitter plate 30.

The housing 10 includes a cylindrical body 12 and a plurality of protruding portions 14. The body 12 defines an air channel 13. The plurality of protruding portions 14 extends outwards from the body 12, and each protruding portion 14 defines an introduction channel 142 in communication with the air channel 13.

The emitter plate 30 is arranged on the protruding portion 14. The emitter plate 30 is provided with a plurality of emitter pins 31 which are located in the introduction channel 142 and face the air channel 13.

The plurality dust collection plates 20 are arranged in the air channel 13 and spaced apart along an axial direction of the body 12. Each dust collection plate 20 corresponds to one emitter plate 30.

With the cooking fume purification module 100, a static electric field is generated between the dust collection plate 20 and the emitter plate 30. Air which is ionized around the emitter pins 31 enter the air channel 13 through the introduction channel 142, greasy fume particles are charged and move, and then are adhered to the dust collection plate 20. Therefore, the greasy fume is purified, and the cleanliness of the greasy fume is improved.

It should be noted that, the dust collection plate 20, the emitter plate 30 and the emitter pins 31 are all conductive. In an embodiment, the dust collection plate 20, the emitter plate 30 and the emitter pins 31 are all made of metal material, such as stainless steel, aluminum alloy and the like.

The dust collection plate 20 may be connected to a positive high-voltage electrode, and the emitter plate 30 may be connected to a negative high-voltage electrode, thereby generating a static electric field between the dust collection plate 20 and the emitter plate 30.

Science the emitter pins 31 are arranged on the emitter plate 30, there are negative high-voltage on the emitter pins 31. High voltage discharge or point discharge occurs on the emitter pins 31. Air in the introduce channel 142 is ionized into anions, and the anions aperture energy under the action of the static electric field. The anions around the emitter pins 31 move towards the dust collection plate 20. When the greasy fume particles pass through the air channel 13, the greasy fume particles combine with the anions and are negative. The greasy fume particles move towards and finally adhere to the dust collection plate 20. With the cooking fume purification module 100, greasy fume emission can be reduced, achieving purification of greasy fume. It should be noted that, in an example, the high voltage ranges from 8000 V to 40000V. For example, the high voltage may be 8000V, 9000V, 10000V, 15000V, 20000V, 30000V, 35000V or 40000V.

In the embodiment, the plurality of emitter pins 31 are arranged on the emitter plate 30 in an array, which facilitates mounting of the emitter pins 31 and distribution of the static electric field.

In some embodiments, the body 12 is cylindrical, and the plurality of protruding portions 14 tangentially extend outwards from the circumference of the body 12.

Therefore, when entering the air channel 13 from the introduce channel 142, air ionized by the emitter pins 31 have a tangential speed which is substantially perpendicular to a flowing direction of the greasy fume, thereby making an electric field force and an inertial centrifugal force exert on the greasy fume for a longer time, such that the greasy fume particles are charged. The effect of purification of the cooking fume purification module 100 can be improved.

In some embodiments, the cooking fume purification module 100 includes a hub 22 arranged at a center of the air channel 13. Each dust collection plate 20 is connected to the hub 22 and a joint 15 between the protruding portion 14 and the circumference of body 12 in a tangential direction. That is an end of the dust collection plate 20 is connected with the hub 22, and another end of the dust collection plate 20 is connected with the joint 15 between the protruding portion 14 and the circumference of body 12 in the tangential direction.

Therefore, the hub 22 can fix the plurality of dust collection plates 20, which make it convenient to mount the plurality of dust collection plates 20 in the air channel 13. An edge of the dust collection plate 20 is connected with the joint 15 between the protruding portion 14 and the circumference of body 12 in the tangential direction, such that the anions are cyclonic by means of the dust collection plate 20. The greasy fume particles can be separated under the actions of the electric field force and the inertial centrifugal force, which further improves the effect of fume purification.

In some embodiments, each dust collection plate 20 extends from the hub 22 to the joint 15 in a manner of log spiral.

The log spiral dust collection plate 20 enlarges an area of an outside surface of the dust collection plate 20, which makes the dust collection plate 20 adsorb more greasy fume particles, thereby improving the effect of fume purification of the cooking fume purification module 100.

In addition, the log spiral dust collection plate 20 can facilitate reduction of resistance during flowing of the anions ionized from air, such that the greasy fume particles can easily combine with the anions.

In some embodiment, the hub 22 defines a plurality of slots 222, the plurality of slots are spaced apart in a circumferential direction of the hub 20. Each dust collection plate 20 is detachably inserted in a slot 222. The number of the slot 222 may be, such as 2, 3, 4, 5 and 6.

Therefore, the slots 222 facilitate mounting/dismounting the dust collection plates 20 to/from the hub 22. Each dust collection plate 20 can be conveniently dismounted from the hub 22, greasy fume particles adhered to the dust collection plate 20 can be cleaned.

For example, the slot 222 can be detachably connected to the dust collection plate 20 by means of interference fit.

In some embodiments, there may be four protruding portions 14, and the four protruding portions 14 are evenly spaced apart in the circumferential direction of the body 12.

It should be noted that, in other embodiments, the number of the protruding portions 14 may be different, such as 2, 3, 5 and 6, etc.

In some embodiments, the protruding portion 14 defines an opening 144 in communication with the outside of the protruding portion 14 and the introduction channel 142, and the emitter plate 30 covers the opening 144.

The emitter plate 30 is arranged at the opening 144, which makes it easy to mount and dismount the emitter plate 30. The emitter plate 30 can be conveniently maintained during usage.

In some embodiments, each emitter pin 31 is provided with a plurality of rows of emitting tips.

The emitting tips can be made from an electric conductive material, such as carbon fiber. The emitting tips can ionize air by discharging, which can increase release equivalent of the anions, thereby enhancing emitting of the anions and further improving the effect of purification of the cooking fume purification module 100.

In some embodiment, the cooking fume purification module 100 includes an electrostatic generator 40, a connecting end of the electrostatic generator 40 is connected to the dust collection plate 20, and another connecting end of the electrostatic generator 40 is connected to the emitter plate 30.

For example, a positive connecting end of the electrostatic generator 40 is connected to the dust collection plate 20, and a negative connecting end of the electrostatic generator 40 is connected to the emitter plate 30. A work voltage of 220 V is applied to the electrostatic generator 40, the electrostatic generator 40 can boost the voltage of 220 V up to a high voltage by means of a circuit, and the electrostatic generator 40 is connected to the dust collection plate 20 and the emitter plate 30 by means of connecting ends.

In one embodiment, the electrostatic generator 40 can convert an alternating current into a stable direct current source by means of a circuit, such as a voltage reduction circuit, a rectification and filter circuit, a voltage stabilization circuit and the like. The direct current source serves as an output voltage which is boosted into the high voltage by means of a self-excited oscillation circuit and a multistage voltage doubling rectifying circuit.

In some embodiments, adjacent two dust collection plates 20 define an air sub-channel 132. Each air sub-channel 132 is in communication with a corresponding introduction channel 142. A plurality of air sub-channels 132 form the air channel 13. Therefore, sufficient anions can be introduced into each air sub-channel 132, such that the greasy fume particles in the air sub-channel 132 is provided with negative electricity and can be absorbed onto the dust collection plates 20.

Figure 3:
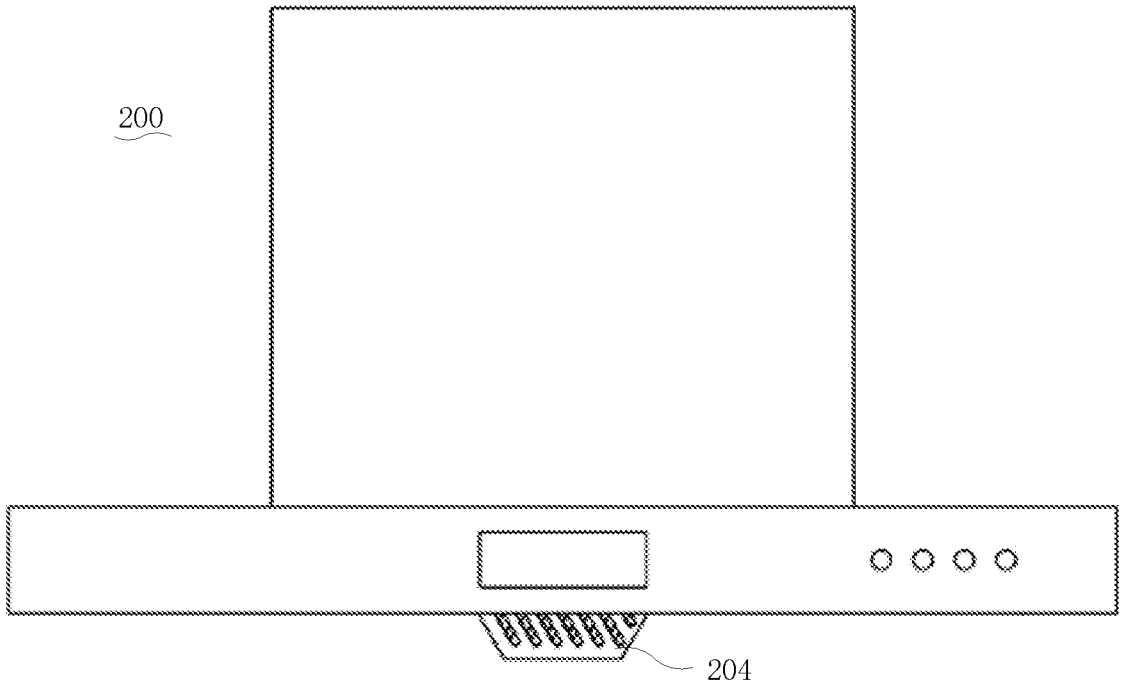
FIG. 3 is a plan view of a cooking fume exhaust device of an embodiment of the present disclosure.
Figure 4:
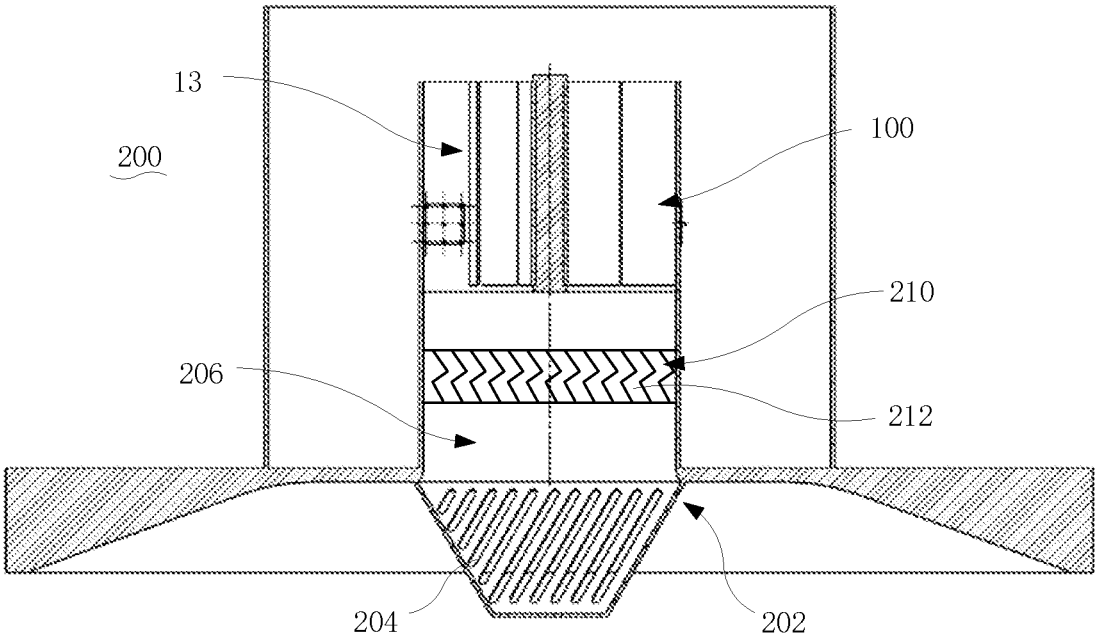
FIG. 4 is a sectional view of a cooking fume exhaust device of an embodiment of the present disclosure.

Please refer to FIG. 3 and FIG. 4, a cooking fume exhaust device 200 according to an embodiment of the present disclosure includes the cooking fume purification module 100 according to anyone of above embodiments.

With the cooking fume exhaust device 200, a static electric field is generated between the dust collection plate 20 and the emitter plate 30. Air which is ionized around the emitter pins 31 enter the air channel 13 through the introduction channel 142, greasy fume particles are charged and move, and then are adhered to the dust collection plate 20. Therefore, the greasy fume is purified, and the cleanliness of the greasy fume is improved.

In one embodiment, the cooking fume exhaust device 200 defines a fume intake opening 202, and the fume intake opening 202 is in communication with the air channel 13. A wheel (not shown) may be arranged in the cooking fume exhaust device 200. Generally, the cooking fume exhaust device 200 is mounted over a cooking range. When a user cooks on the cooking range, the user can start the cooking fume exhaust device 200 to make the wheel rotate. The wheel rotates and sucks greasy fume generated by a cooker on the cooking range into the cooking fume exhaust device 200 through the intake opening 202, and then the greasy fume is discharged to the cooking fume purification module 100. The cooking fume purification module 100 is in communication with the outdoor, and the greasy fume is purified in the cooking fume purification module 100 and then is discharged to the outdoor.

During operation and rotation of the wheel, on the one hand, the greasy fume can be sucked through the fume intake opening 202 and then is discharged to the cooking fume purification module 100, on the other hand, the greasy fume can be divided into smaller particles, which facilitate decomposition of the greasy fume in the cooking fume purification module 100.

In order to prolong a serve life of the cooking fume exhaust device 200, a filter screen 204 is arranged at the fume intake opening 202. The filter screen 204 can filter large greasy fume particles out, to prevent the large greasy fume particles, which affect normal operation of the cooking fume exhaust device 200, from directly entering the cooking fume exhaust device 200.

In some embodiments, the cooking fume exhaust device 200 defines a greasy fume passage 206, and the air channel 13 is in communication with the greasy fume passage 206.

The greasy fume passage 206 can deliver the greasy fume to the air channel 13, such that the greasy fume can be purified. The greasy fume passage 206 is in communication with the fume intake opening 202, and the wheel may be mounted in the greasy fume passage 206, such that the greasy fume can be sucked through the fume intake opening 202 during operation of the wheel, and the greasy fume passes through the greasy fume passage 206 and enter the air channel 13.

In some embodiments, the cooking fume exhaust device 200 includes a flow-adjustment module 210 which is arranged in the greasy fume passage 206. Compared with the cooking fume purification module 100, the flow-adjustment module 210 is arranged at an upstream of a greasy fume flow. The flow-adjustment module 210 defines a plurality of flow-adjustment passages 212 extending in an axial direction of the greasy fume passage 206 in an undulate manner. The flow-adjustment passages 212 are in communication with the air channel 13.

Therefore, the plurality of flow-adjustment passage 212 can increase resistance in the greasy fume passage 206, such that large greasy fume particles can be separated, and the large greasy fume particles can be divided into small greasy fume particles. Smaller greasy fume particles enter the air channel 13, which facilitates combination of the greasy fume particles and the anions to charge the greasy fume particles with negative electricity, such that the greasy fume particles can be adhered to the dust collection plates 20.

Figure 5:
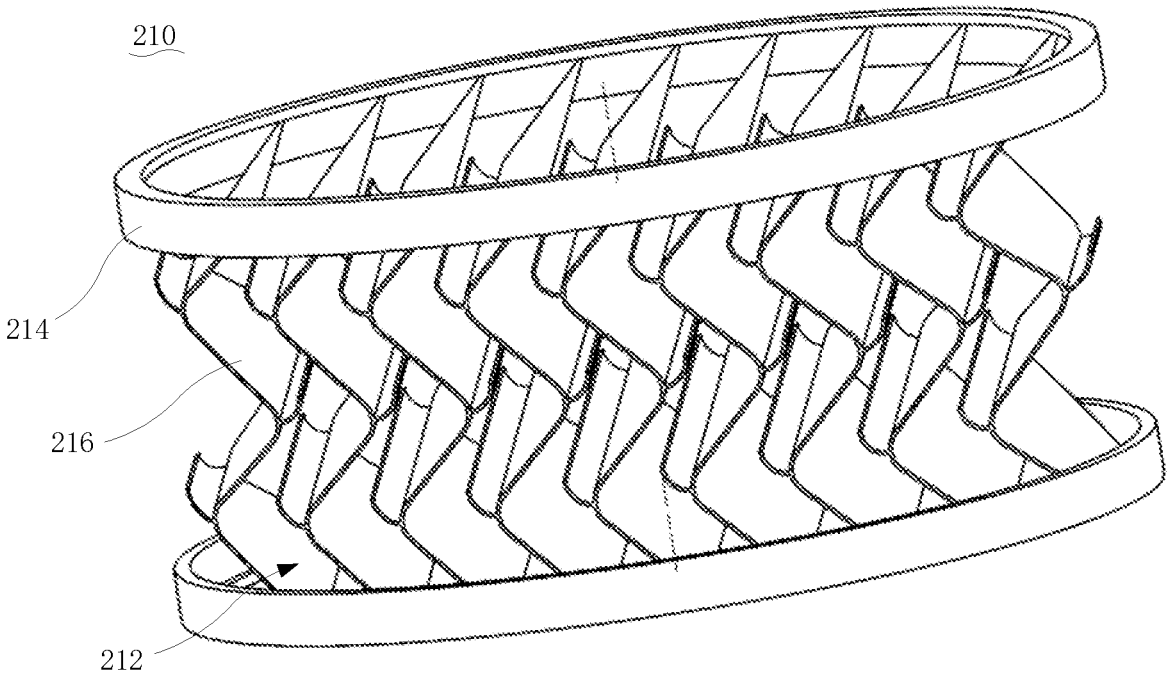
FIG. 5 is a perspective view of a flow-adjustment module a cooking fume exhaust device of an embodiment of the present disclosure.

Please refer to FIG. 5, the flow-adjustment module 210 includes a framework 214 and a plurality of flow-adjustment plates 216. The plurality of flow-adjustment plates 216 are stacked up on the framework 214 in a radial direction of the greasy fume passage 206. Each flow-adjustment plate 216 undulates and extends in an axial direction of the greasy fume passage 206. Adjacent two flow-adjustment plates 216 corporately define the flow-adjustment passage 212.

The framework 214 cam be a ring, such that the flow-adjustment module 210 is substantially cylindrical, and the flow-adjustment module 210 can match the greasy fume passage 206 better. The flow-adjustment plates 216 are welded to the framework 214 to form the flow-adjustment module 210.

Reference throughout this specification to "an embodiment," "some embodiments," "illustrative embodiment", "an example," "a specific example," or "some examples," means that a particular feature, structure, material, or characteristic described in connection with the embodiment or example is included in at least one embodiment or example of the present disclosure. Thus, the appearances of the phrases are not necessarily referring to the same embodiment or example of the present disclosure. Furthermore, the particular features, structures, materials, or characteristics may be combined in any suitable manner in one or more embodiments or examples.

What is claimed is:

1. A cooking fume purification module, comprising:

a housing, the housing comprising a cylindrical body defining an air channel; and a plurality of protruding portions protruding outwards from the body, and each protruding portion defining an introduction channel in communication with the air channel;

an emitter plate arranged on the protruding portion and provided with a plurality of emitter pins located in the introduction channel; and a plurality of dust collection plates arranged in the air channel and spaced apart about an axial direction of the body, and each dust collection plate corresponding to one emitter plate.

2. The cooking fume purification module according to claim 1, wherein the body is cylindrical, and the plurality of protruding portions tangentially extend outwards from a circumference of the body.

3. The cooking fume purification module according to claim 2, wherein the cooking fume purification module further comprises a hub arranged at a center of the air channel, each dust collection plate is connected to the hub and a joint between the extending portion and the circumference of body in a tangential direction.

4. The cooking fume purification module according to claim 3, wherein each dust collection plate extends from the hub to the joint in a manner of log spiral.

5. The cooking fume purification module according to claim 3, wherein the hub defines a plurality of slots, the plurality of slots are spaced apart in a circumferential direction of the hub, and each dust collection plate is detachably inserted in a slot.

6. The cooking fume purification module according to claim 5, wherein the slot is detachably connected to the dust collection plate by means of interference fit.

7. The cooking fume purification module according to claim 1, wherein four protruding portions are provided, and the four protruding portions are evenly spaced apart in a circumferential direction of the body.

8. The cooking fume purification module according to claim 1, wherein the protruding portion defines an opening in communication with an outside of the protruding portion and the introduction channel, and the emitter plate covers the opening.

9. The cooking fume purification module according to claim 1, wherein each emitter pin is provided with a plurality of rows of emitting tips.

10. The cooking fume purification module according to claim 1, wherein the cooking fume purification module further comprises an electrostatic generator, a connecting end of the electrostatic generator is connected to the dust collection plate, and another connecting end of the electrostatic generator is connected to the emitter plate.

11. The cooking fume purification module according to claim 1, wherein adjacent two dust collection plates define an air sub-channel, each air sub-channel is in communication with a corresponding introduction channel, and a plurality of air sub-channels form the air channel.

12. A cooking fume exhaust device comprising:

a cooking fume purification module, comprising:

a housing, the housing comprising a cylindrical body defining an air channel; and a plurality of protruding portions protruding outwards from the body, and each protruding portion defining an introduction channel in communication with the air channel;

an emitter plate arranged on the protruding portion and provided with a plurality of emitter pins located in the introduction channel; and a plurality of dust collection plates arranged in the air channel and spaced apart winding along an axial direction of the body, and each dust collection plate corresponding to one emitter plate.

13. The cooking fume exhaust device according to claim 12, wherein the cooking fume exhaust device defines a greasy fume passage, and the air channel is in communication with the greasy fume passage.

14. The cooking fume exhaust device according to claim 13, further comprising a flow-adjustment module arranged in the greasy fume passage, wherein compared with the fume purification module, the flow-adjustment module is arranged at an upstream of a greasy fume flow, the flow-adjustment module defines a plurality of flow-adjustment passages extending in an axial direction of the greasy fume passage in an undulate manner, and the flow-adjustment passages are in communication with the air channel.

15. The cooking fume exhaust device according to claim 14, wherein the flow-adjustment module comprises:

a framework; and a plurality of flow-adjustment plates stacked up on the framework in a radial direction of the greasy fume passage, each flow-adjustment plate undulating and extending in an axial direction of the greasy fume passage, and adjacent two flow-adjustment plates corporately defining the flow-adjustment passage.

16. The cooking fume exhaust device according to claim 15, wherein the framework is a ring.

17. The cooking fume exhaust device according to claim 13, further comprising a wheel arranged in the greasy fume passage.

18. The cooking fume exhaust device according to claim 13, defining a fume intake opening, and the fume intake opening being in communication with the greasy fume passage.

* * * * *